US005463843A

United States Patent [19]

Sharp

[11] Patent Number: 5,463,843

[45] Date of Patent: Nov. 7, 1995

[54] BULK PACKAGE WRAPPING AND SECURING SYSTEM

[75] Inventor: Dennis Sharp, Albany, Oreg.

[73] Assignee: James River Corporation of Virginia, Richmond, Va.

[21] Appl. No.: 275,295

[22] Filed: Jul. 14, 1994

Related U.S. Application Data

[63] Continuation of Ser. No. 973,694, Nov. 9, 1992, abandoned.

[51] Int. Cl.[6] ..... B65B 13/02; B65B 53/00

[52] U.S. Cl. ..... 53/399; 53/441

[58] Field of Search ..... 206/83.5, 597; 100/2, 9; 53/399, 414, 441, 463, 477, 556, 138.6, 139.4, 582, 588

[56] References Cited

U.S. PATENT DOCUMENTS

| | | | |
|---|---|---|---|
| 3,986,611 | 10/1976 | Dreher | 53/441 X |
| 4,204,377 | 5/1980 | Lancaster et al. | 53/441 X |
| 4,271,657 | 6/1981 | Lancaster et al. | 53/441 X |
| 4,619,102 | 10/1986 | Geisinger | 53/441 X |
| 5,195,297 | 3/1993 | Lancaster et al. | 53/441 X |
| 5,216,871 | 6/1993 | Hannen | 53/441 X |

OTHER PUBLICATIONS

Infrapak Digest, 1977.

*Primary Examiner*—Linda Johnson
*Attorney, Agent, or Firm*—Thomas R. Lampe

[57] ABSTRACT

A system of wrapping and securing together the components of a bulk package including a bottom tray element and a top cap element with an integral web of plastic material. The plastic material, while in a rope-like configuration, is looped about only a single pair of diagonally opposed corners of each of the top cap element and bottom tray element. The tail or terminal end of the web is secured in place by being positioned between a wrap convolution and the bulk package.

3 Claims, 7 Drawing Sheets

BULK PACKAGE WRAPPING AND SECURING SYSTEM

This is a continuation of application Ser. No. 07/973,694 filed Nov. 9, 1992, now abandoned.

TECHNICAL FIELD

This invention relates to bulk packages, and more particularly, to a system of wrapping and securing together with an integral web of plastic material the components of a four-sided bulk package including objects stacked in layers with each layer comprising a plurality of objects disposed in rows. The invention encompasses both the method employed to wrap and secure together the bulk package components and the wrapped and secured bulk package itself.

BACKGROUND ART

U.S. Pat. No. 4,897,980, issued Feb. 6, 1990, discloses an apparatus for forming a bulk package, the bulk package including objects stacked in layers with each layer comprising a plurality of the objects disposed in rows, a bottom tray disposed under the lower-most layer, and a top cap positioned over the upper-most layer of stacked objects. The patent also suggests covering the bulk package with an outer wrap such as plastic film to protect the objects, which may, for example, be packs of paper towels, and contribute to the structural integrity of the bulk package.

In the commercialization of the bulk package disclosed in the U.S. Pat. No. 4,897,980, the practice has been developed of utilizing the Cobra Stretch Wrapper to wrap the bulk package which has been utilized in the field of paper products, namely, paper towel, paper tissue, and paper napkin products. In particular, the Cobra Stretch Wrapper (which is made available by MIMA PACKAGING, Boca Raton, Fla.) is currently employed to practice what is known in the art as the four-corner wrapping method with a heat-seal at the end of the wrap cycle. The four-corner wrapper with heat-seal process will be described in some detail below, but it may be summarized as a system which loops a plastic "rope" (formed by compressing a plastic web) about all four corners of both the bottom tray and top cap of the package. The mechanical action of guiding the plastic rope-like web segment over and under each of the corners results in a great deal of mechanical wear on the Cobra Stretch Wrapper, rendering it prone to mechanical failure.

Another aspect of the prior art four-corner wrapper with heat-seal process is that it employs the step of finishing off the wrapping operation by joining two terminal ends of segments of the web having a rope-like configuration by heat sealing. That is, two loose "rope" ends are compressed together between two heated metal pads to melt the ends in an attempt to bond them when cooling takes place.

While the heat-seal produced at the end of the wrap cycle has a pleasing aesthetic appear, it has been found that there has been an extremely high failure rate of the heat weld seals by the time the bulk package reaches its final destination. This will result in a long segment of plastic "rope" (which may be in the order of 10 feet or so) dangling from the bulk package. The dangling rope-like web segment is both unsightly and potentially hazardous since it can become entangled in fork-lift truck wheels and the like.

Another deficiency of the prior art four-corner wrapper with heat-seal process is that the equipment employed to heat bond the "rope" ends is quite complex and prone to "mechanical and electrical failure. Also, of course, wrapping about all four corners of the bottom tray and top cap uses a considerable amount of plastic web material.

DISCLOSURE OF INVENTION

The system of the present invention encompasses both a method and a structural combination.

According to the method of the present invention, the components of a four-sided bulk package are wrapped and secured together with in integral web of plastic material. The bulk package includes objects stacked in layers with each layer comprising a plurality of the objects disposed in rows, a bottom tray element disposed under the lower-most layer having four corners and a substantially rectangular configuration, and a top cap element disposed over the upper-most layer having four corners and a substantially rectangular configuration. The top cap element and the bottom tray element are in substantial registry.

According to the method, a first segment of the web of plastic material is compressed into a rope-like configuration. The first web segment is then wrapped at least once about the outer periphery of the bulk package defined by the sides of the bulk package.

After the step of wrapping the first web segment, the first web segment is secured in place on the bulk package.

After the securing step, a second segment of the web of plastic material is compressed into a rope-like configuration. The second web segment is looped about only a single pair of diagonally opposed corners of each of the top cap element and the bottom tray element. The single pair of diagonally opposed corners of the top cap element about which the second web segment is looped is generally ninety degrees out of registry with the single pair of diagonally opposed corners of the bottom tray element about which the second web segment is looped.

After the step of looping the second web segment, a third segment of the web is wrapped about the sides of the bulk package with the web in a substantially uncompressed state to substantially cover the sides of the bulk package. After the wrapping step, the web is secured to itself.

The method includes the additional steps of compressing a fourth segment of the web of plastic material into a rope-like configuration after the step of wrapping the third web segment. The step of securing the web to itself includes wrapping the fourth web segment about the bulk package, severing the fourth web segment to provide a fourth web segment terminal end, and positioning the fourth web segment terminal end between a portion of the fourth web segment wrapped about the bulk package and the bulk package.

The present invention also encompasses a wrapped and secured bulk package. The bulk package includes objects stacked in layers with each layer comprising a plurality of objects disposed in rows, a bottom tray element disposed under the lowermost layer having four corners and a substantially rectangular configuration and a top cap element disposed over the upper-most layer having four corners and a substantially rectangular configuration. The top cap element and the bottom tray element are in substantial registry.

An integral web of plastic material wraps and secures together the bulk package. The web has a first web segment with a rope-like configuration wrapped about the outer periphery of the bulk package defined by the sides of the bulk package. The web also includes a second web segment with a rope-like configuration looped about only a single pair of diagonally opposed corners of each of the top cap element and the bottom tray element, with the single pair of diagonally opposed corners of a top cap element about which the second web segment is looped being generally ninety degrees out of registry with the single pair of diagonally opposed corners of the bottom tray element about which the second web segment is looped.

The web additionally incorporates a third web segment in a substantially uncompressed state wrapped about the sides of the bulk package to substantially cover the sides. A fourth web segment with a rope-like configuration is wrapped about the bulk package and has a terminal end positioned between a portion of the fourth web segment wrapped about said bulk package and the bulk package.

Other features, advantages, and objects of the present invention will become apparent with reference to the following description and accompanying drawings.

BEST MODE FOR CARRYING OUT THE INVENTION

Figure 2:
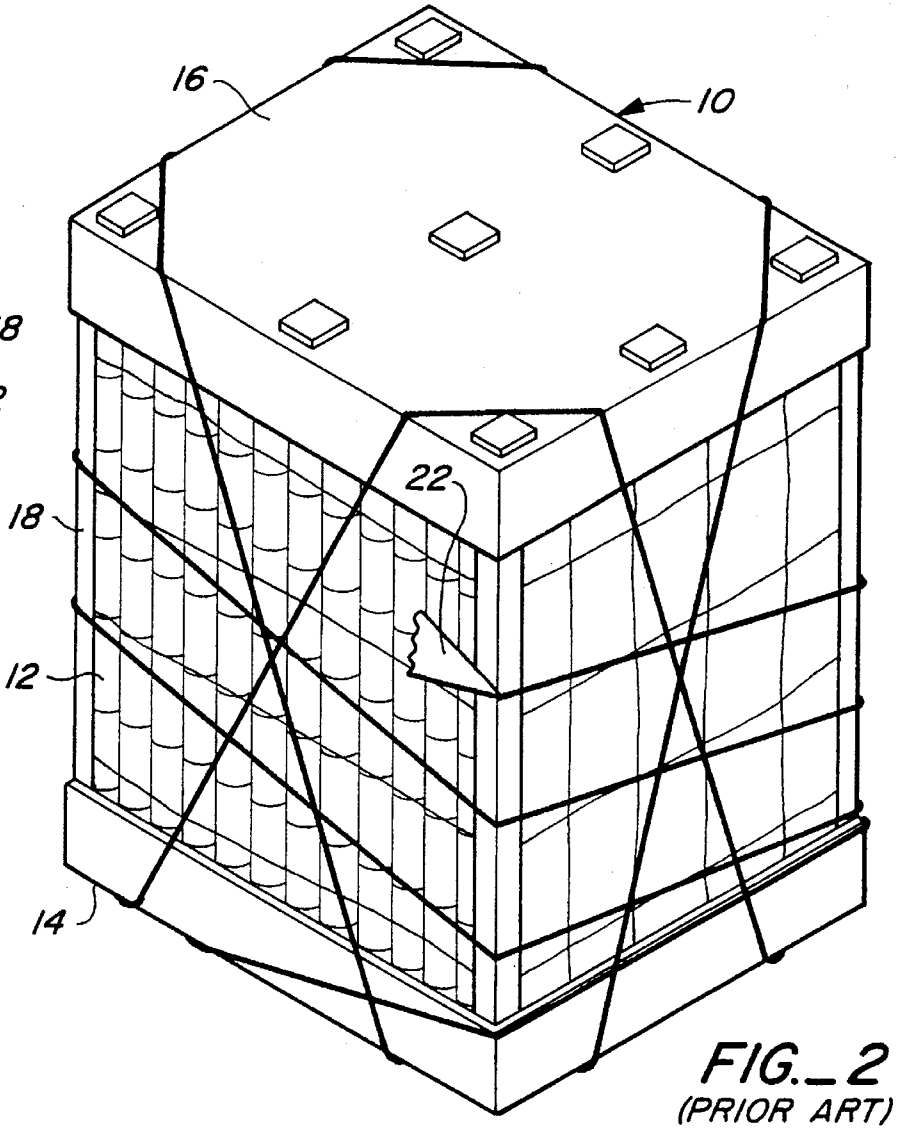
FIG. 2 (PRIOR ART)
FIG. 2 is a view similar to FIG. 1, but showing the prior art wrapped bulk package rotated to a position ninety degrees from the position shown in FIG. 1.
Figure 1:
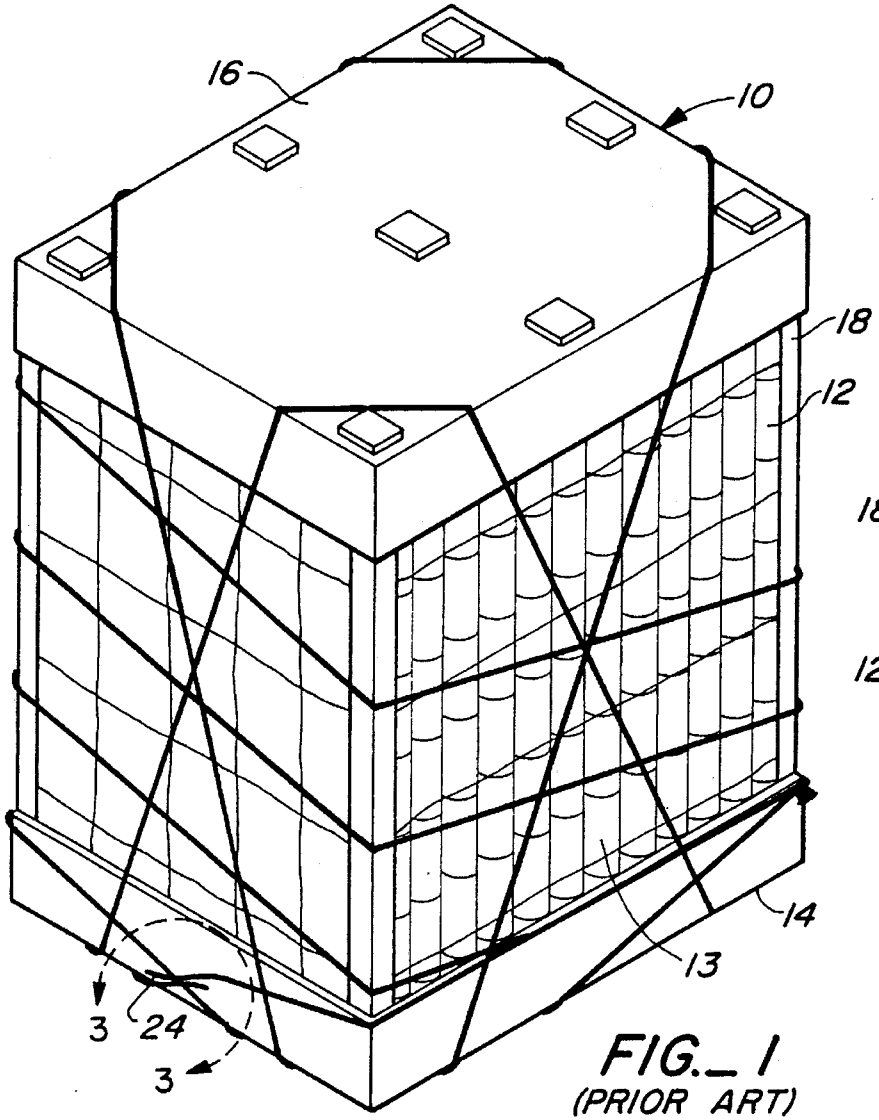
FIG. 1 (PRIOR ART)
FIG. 1 is a perspective elevational view of a bulk package wrapped in accordance with the teachings of the prior art.
Figure 3:
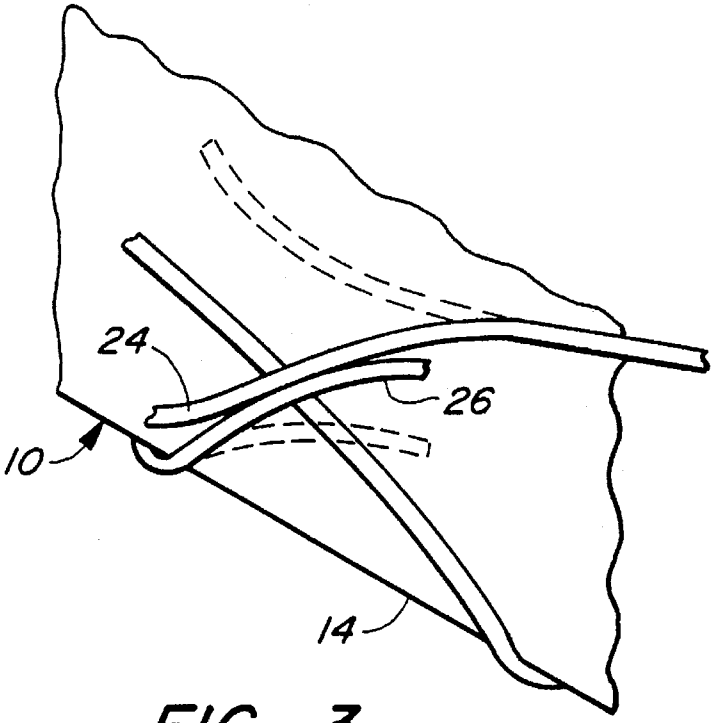
FIG. 3 (PRIOR ART)
FIG. 3 is an enlarged partial view of the wrapped prior art bulk package; in particular, of that portion of the package denoted by line 3—3 in FIG. 1.

The prior art approach for wrapping and securing together with an integral web of plastic material the components of a four-sided bulk package is illustrated in FIGS. 1 through 3. More particularly, the prior art approach is known in the industry as the "four-corner wrapper with heat-seal" process.

A bulk package 10 is shown which is of the general type disclosed in afore-mentioned U.S. Pat. No. 4,897,980 and includes objects 12 stacked in layers with each layer comprising a plurality of the objects disposed in rows. In the drawings, the objects 12 are, for illustrative purposes, individual packages, each of which contains a plurality of paper tissue rolls or paper towel rolls. For example, each package 12 might accommodate anywhere from three rolls to 12 rolls of tissue or toweling or more. In the interest of clarity, individual unpackaged rolls 13 are shown in FIGS. 1 through 2 at one corner of the bulk package, although it will be appreciated that all rolls in a bulk package are normally packaged.

Bulk package 10 also includes a bottom tray element 14 which is disposed under the lower-most layer of packages 12. The bottom tray element 14 has four corners and a substantially rectangular configuration.

A top cap element 16 is disposed over the upper-most layer of packages and has four corners and a substantially rectangular configuration also. The top cap element and the bottom tray element are in substantial registry. In the arrangement illustrated, the bulk package also includes a plurality of elongated post members 18 extending between the bottom tray element 14 and top cap element 16 at the corners thereof.

Once the components of the bulk package 10 have been assembled, they are wrapped and secured together. As stated above, FIGS. 1–3, disclose the prior art approach utilized for this purpose, namely the four-corner wrapper with heat-seal process, with its attendant noted deficiencies.

Figure 7A:
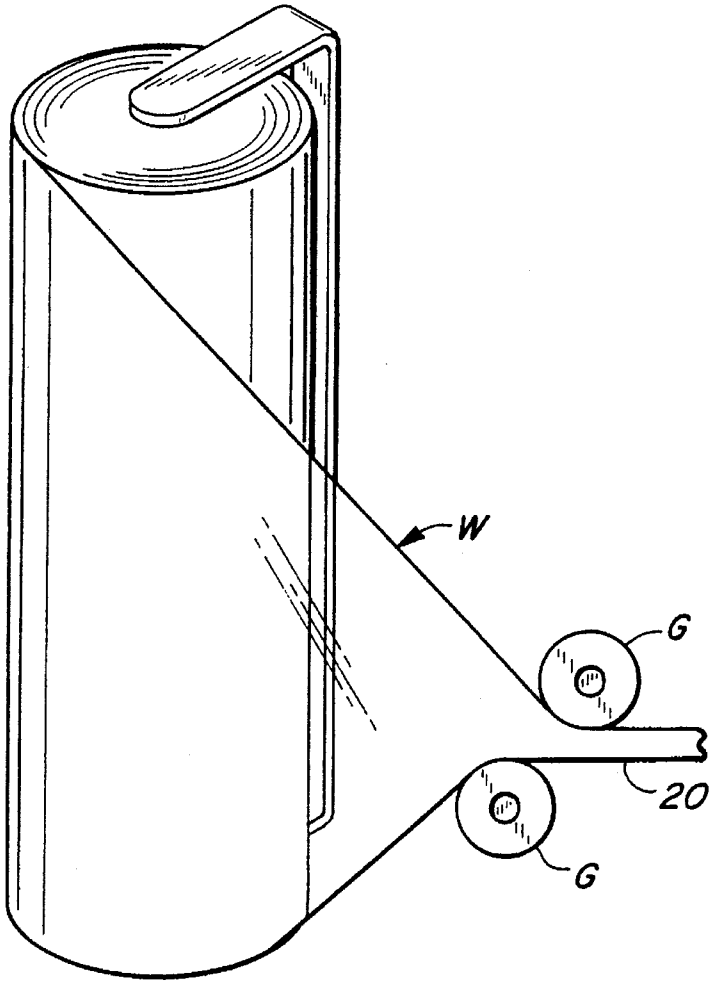
FIG. 7 and 7A are schematic views illustrating components of a wrapper employed when practicing the teachings of the present invention with the components in alternative positions relative to a web.
Figure 7:
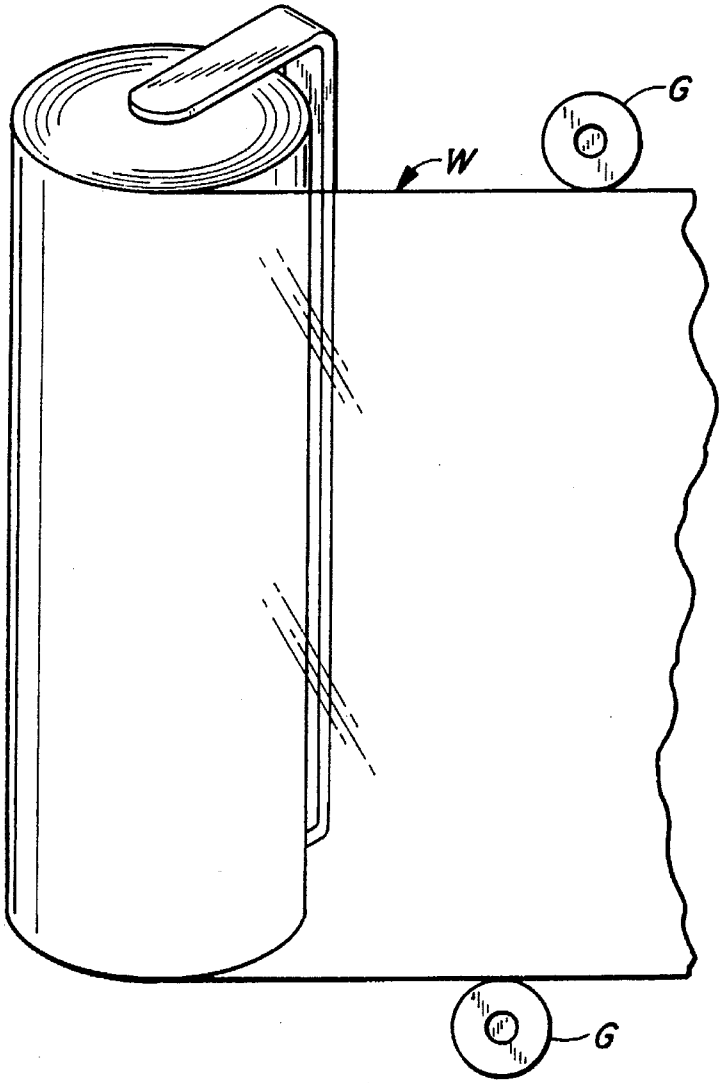

In order to understand the advantages of the present invention as compared to this prior art technique, the four-corner wrapper with heat-seal process will be described with reference to FIGS. 1–3 and also FIGS. 7, 7A.

Wrapping and securement with the four-corner wrapper with heat-seal process is accomplished by means of a plastic web which is applied to the bulk package 10 by a commercially available piece of equipment called the Cobra Stretch Wrapper made available by MIMA PACKAGING of Boca Raton, Fla. The Cobra Stretch Wrapper Machine not only has the capability of moving relative to a bulk package or other object to wrap same but also the capability of applying a web of plastic material in either conventional web form or in a rope-like configuration. This latter configuration is accomplished by the machine by compressing the web width-wise so that the web approximates a rope or band. This is shown schematically in FIGS. 7 and 7A wherein a plastic web W is being unwound from a supply roll and passed between two guides G. When the guides G are separated as shown in FIG. 7, the web is full width, and when the guides G are moved together as shown in FIG. 7A the moving web passing therethrough is compressed into a rope-like configuration. Of course, the actual mechanism of the Cobra Stretch Wrapper machine is far more complex, but since the machine per se forms no part of the present invention and is commercially available, it will not be described in detail.

Figure 1B:
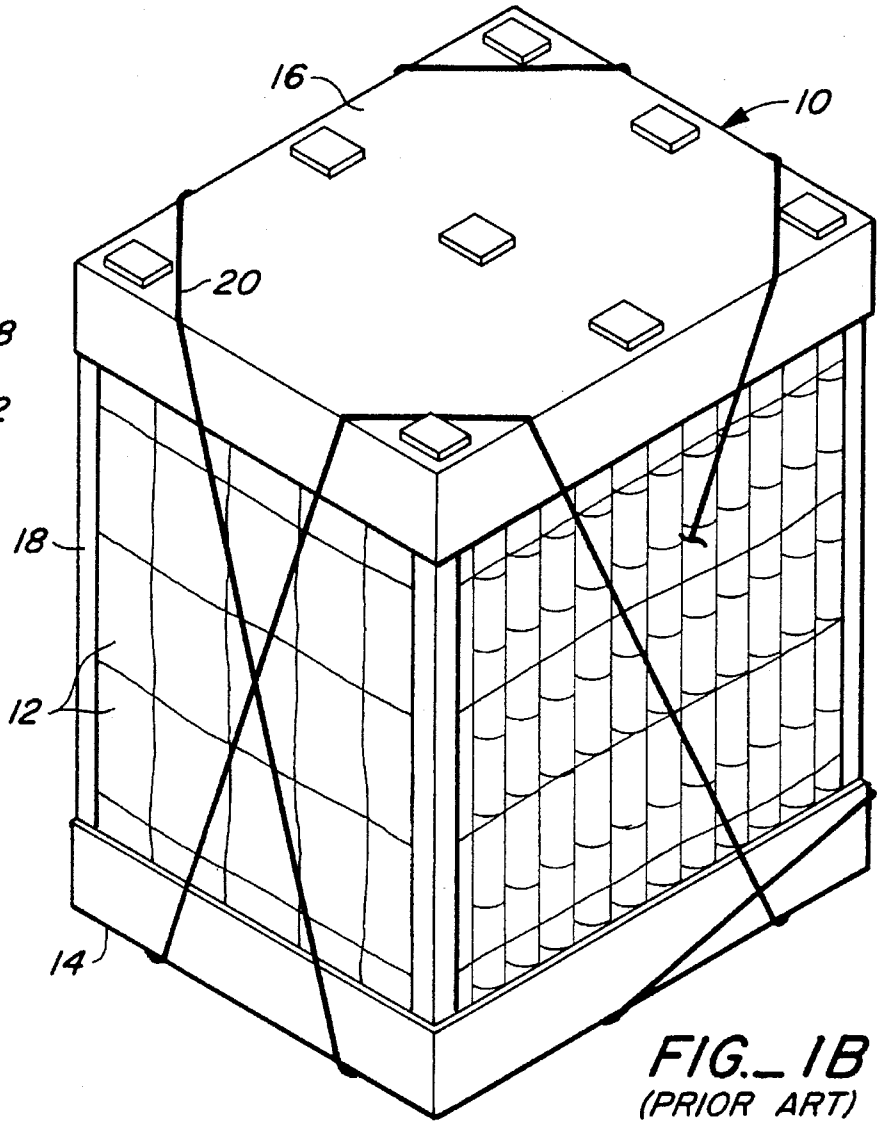
FIG. 1B (PRIOR ART)
FIG. 1A and 1B are perspective elevational views of a bulk package in sequential stages of a prior art wrapping and securing method.
Figure 1A:
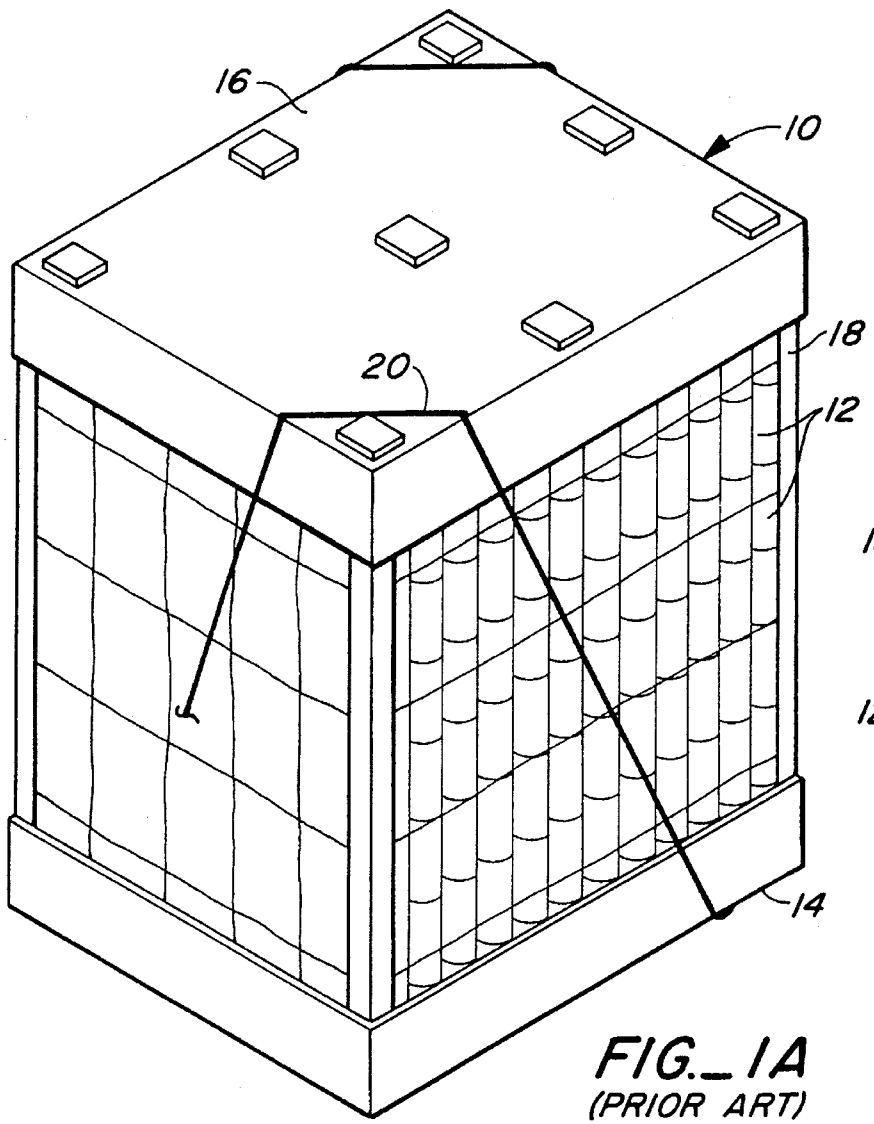
FIG. 1A (PRIOR ART)

In any event, in the prior art technique, the wrap and securement operation commences as shown in FIG. 1A wherein a web of poly or other plastic material (normally in the width range of about 20 inches or so) is compressed into a rope-like configuration 20 as it is reeled off of the plastic sheet material supply roll and passes through the Cobra wrapper. The end of the rope is held by a heat sealer (not shown) and the Cobra wrap machine guides the rope 20 over and under each of the four corners of the bulk package in a criss-cross arrangement, as shown in FIG. 1B, until all four corners of both the bottom tray element 14 and the top cap element 16 have loops formed thereover.

Once all four corners have been roped, the entire load is spirally wrapped by the rope 20 from bottom to top as shown in FIGS. 1 and 2. Now the plastic web is allowed to proceed back to its full width as noted by reference numeral 22 in FIG. 2. The entire load is then wrapped from top to bottom with the web serving as a dust cover.

Once at the bottom of the load, the web is compressed back into a rope-like configuration and cut to form a terminal end 24. This is shown in both FIG. 1, which discloses the completed arrangement, and in more detailed form in FIG. 3. Terminal end 24 is brought into engagement with the initial end 26 of the web from which the securement and wrapping process began.

The ends 24 and 26 are then heat sealed in an attempt to bond them together to maintain the integrity of the wrap. However, as noted above, this arrangement has resulted in an extremely high failure rate, up to ninety-five per cent before the wrapped and secured bulk package reaches its final destination.

By contrast, the approach of the present invention, which will now be described in detail, obviates this and other problems noted with respect to the four-corner wrapper with heat-seal process.

Figure 6:
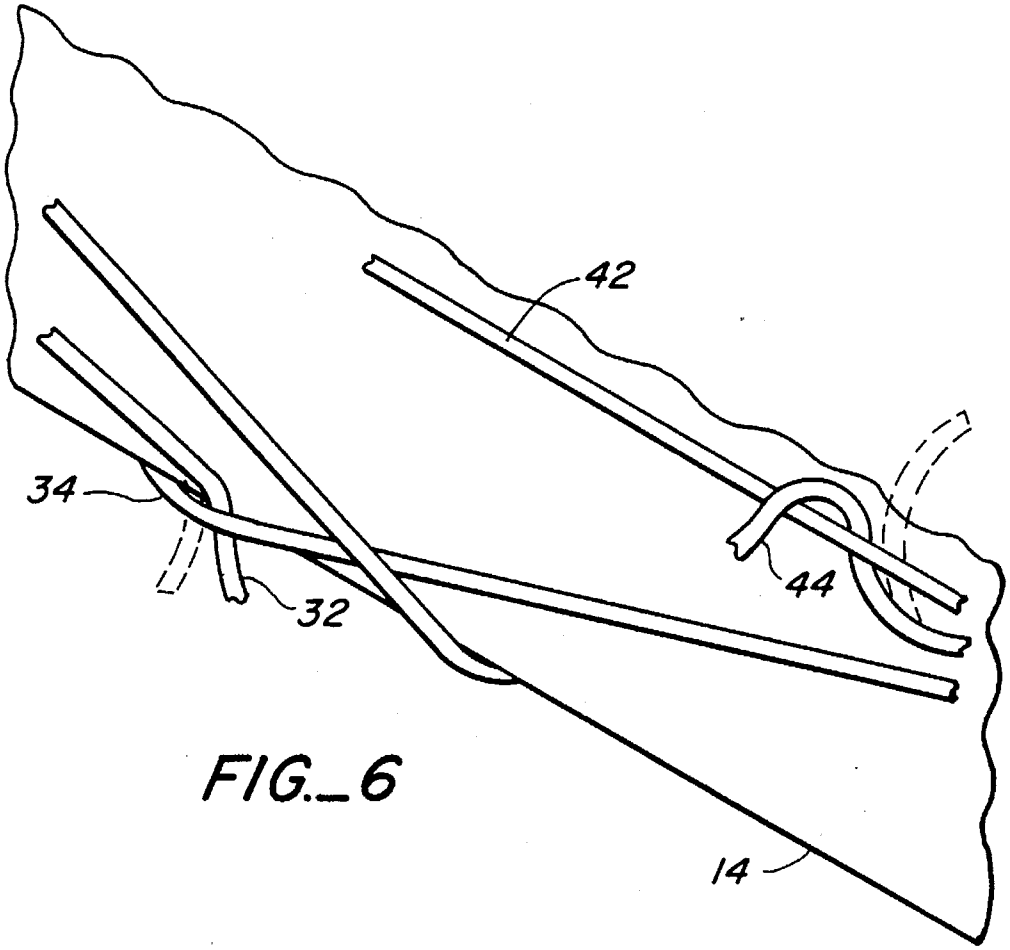
FIG. 6 is an enlarged detail view of that portion of the wrapped and secured bulk package denoted by line 6—6 in FIG. 4.
Figure 5:
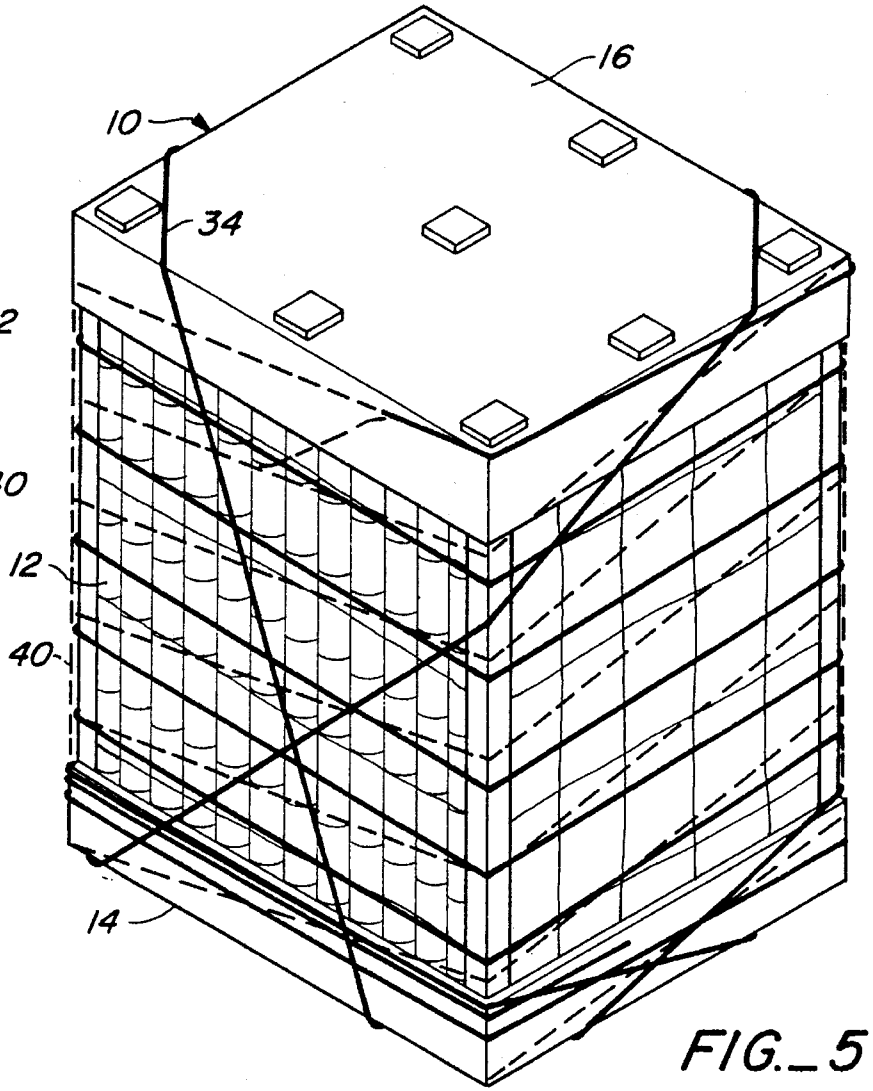
FIG. 5 is a perspective elevational view similar to FIG. 4, but showing the bulk package wrapped and secured in accordance with the teachings of the present invention rotated to a position ninety degrees from the position shown in FIG. 4.
Figure 4:
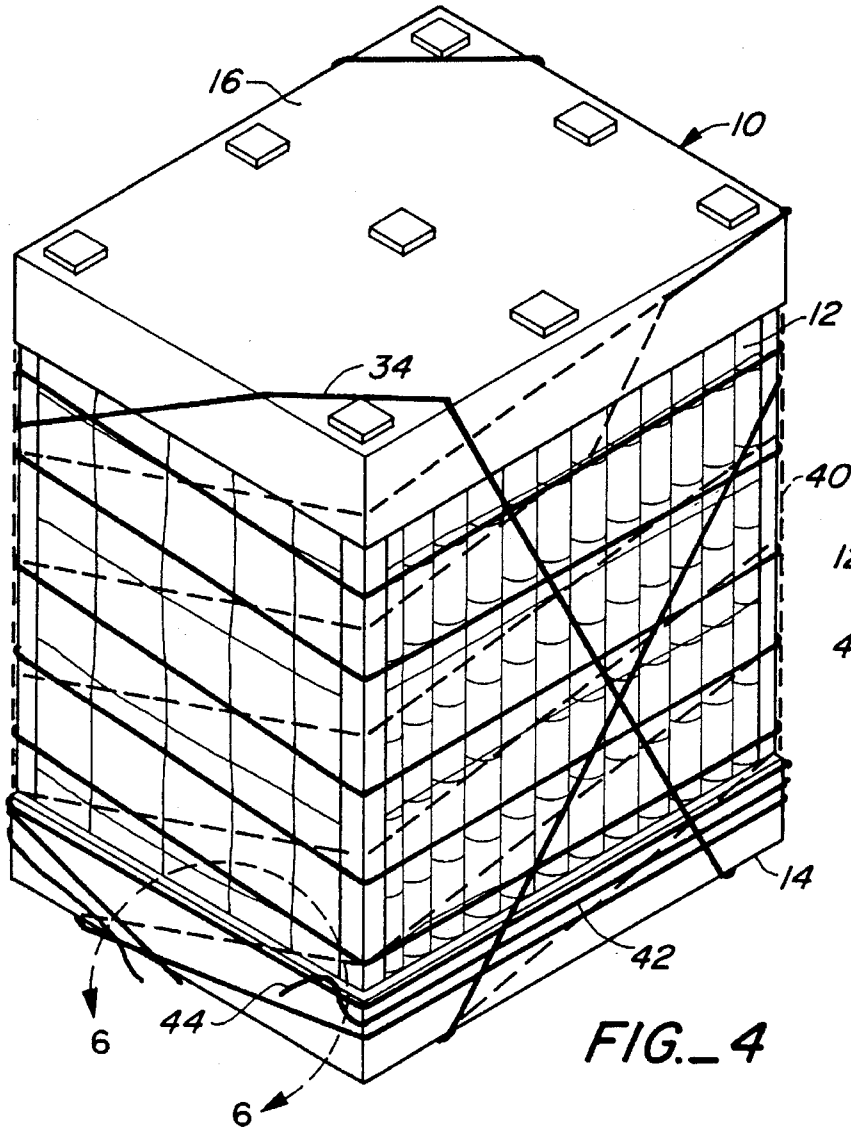
FIG. 4 is a view similar to FIG. 1 but illustrating a bulk package wrapped in accordance with the teachings of the present invention.

FIGS. 4 through 6 illustrate a bulk package 10 wrapped and secured according to the teachings of the present invention. The bulk package is identical to that described above with regard to the prior art wrapping and securement technique and includes objects 12 stacked in layers, with each layer comprising a plurality of the objects disposed in rows, a bottom tray element 14 disposed under the lower-most layer, and a top cap element 16 disposed over the upper-most layer. The bottom tray element and the top cap element each have four corners and a substantially rectangular configuration. The top cap element and the bottom tray element are in substantial registry.

In common with the above-described four-corner wrapper with heat-seal process, the present invention involves wrapping and securing a bulk package with an integral web of plastic material, such as polyethylene. Also in common with the prior art technique, the method of the present invention may be carried out through utilization of the Cobra Stretch Wrapper. Other suitable equipment might be utilized to practice the method of the present invention or it might be carried out manually.

Figure 4D:
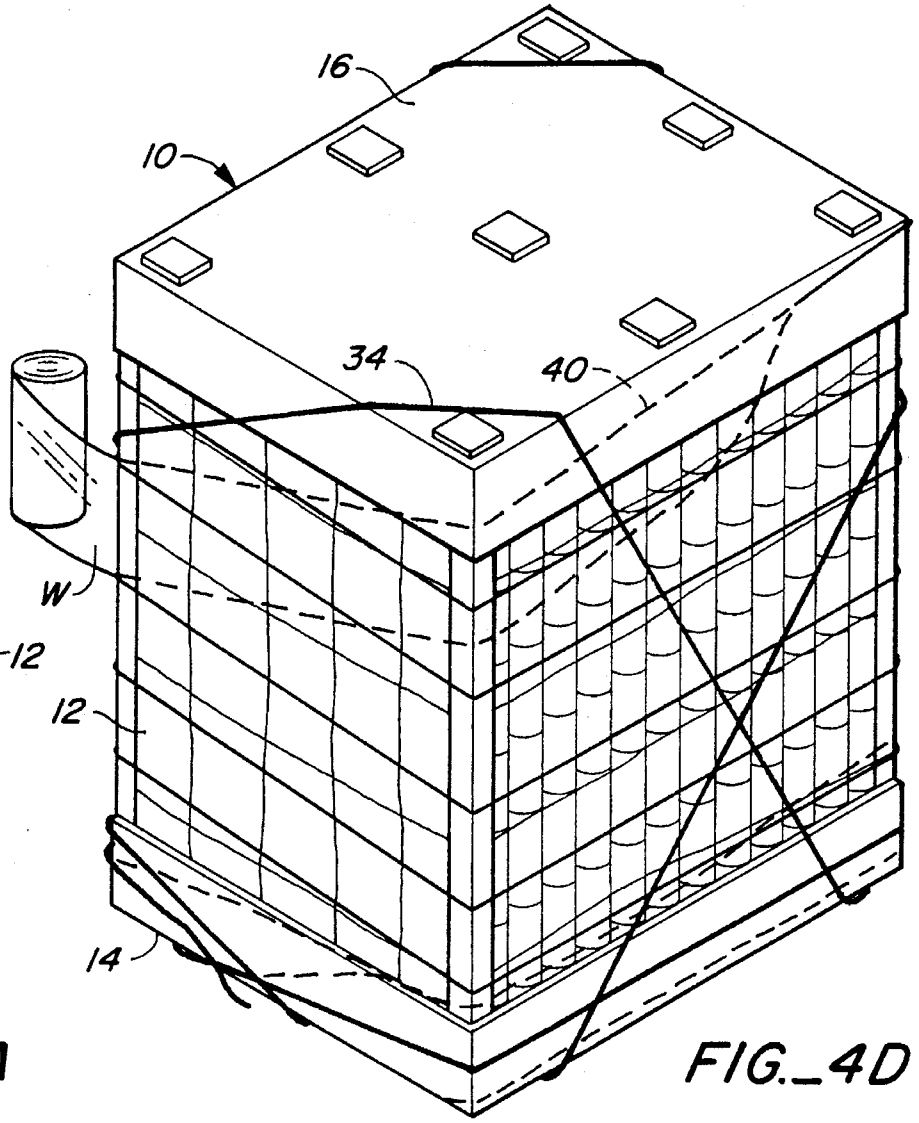
FIGS. 4A through 4D are perspective elevational view illustrating sequential stages of the wrapping and securing method of the present invention as applied to a bulk package.
Figure 4A:
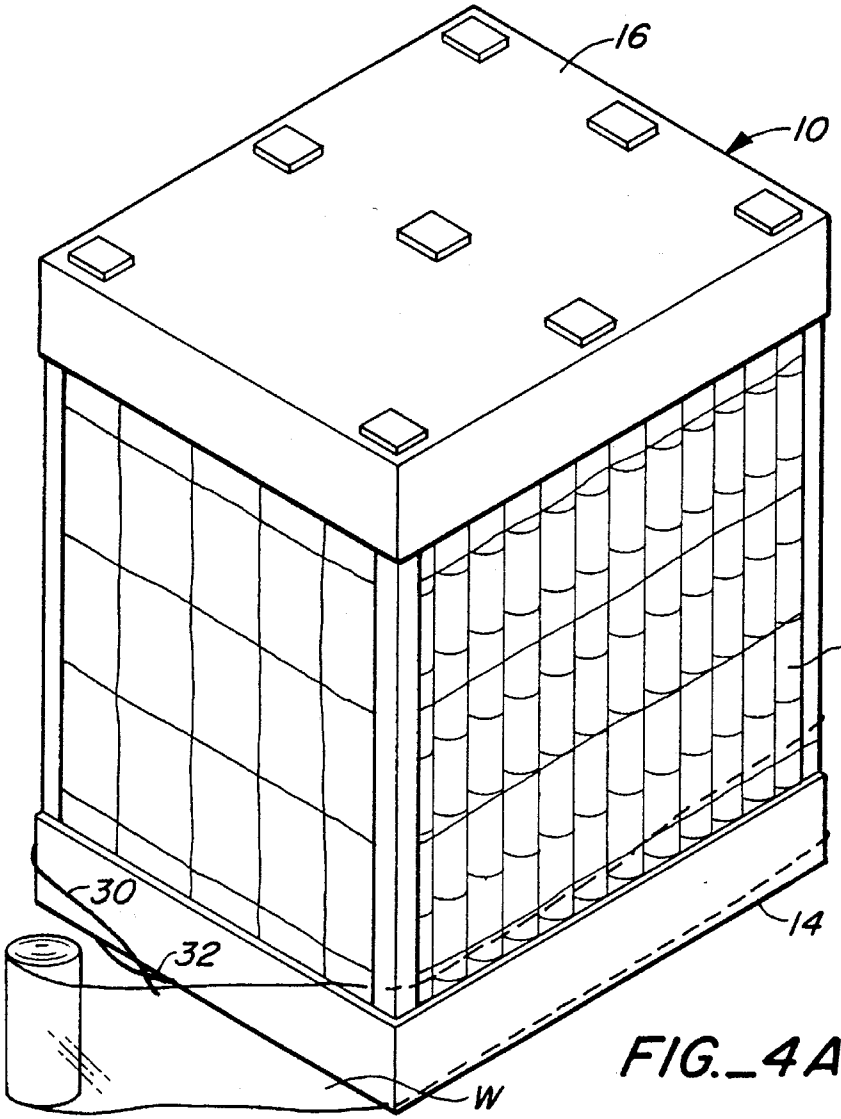

The first step in carrying out the teachings of the present invention is shown in FIG. 4A. The stretch wrap machine compresses a first segment of the web of plastic material having an end 32 into a rope-like configuration, the first web segment being identified by reference numeral 30. First web segment 30 is partially wrapped about the bulk package and the web W is expanded to full width (as shown in dash lines) to complete the wrap over the initial end 32 of the first web segment.

Figure 4C:
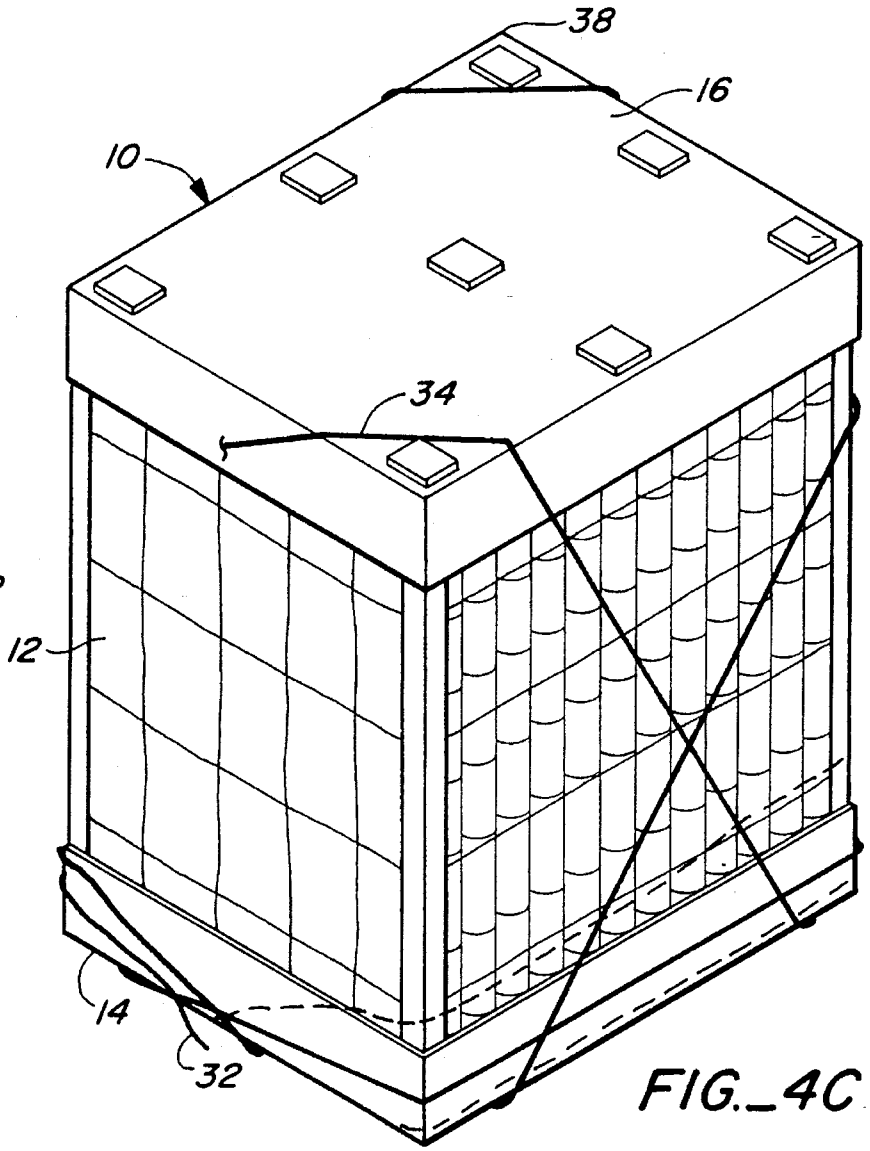
Figure 4B:
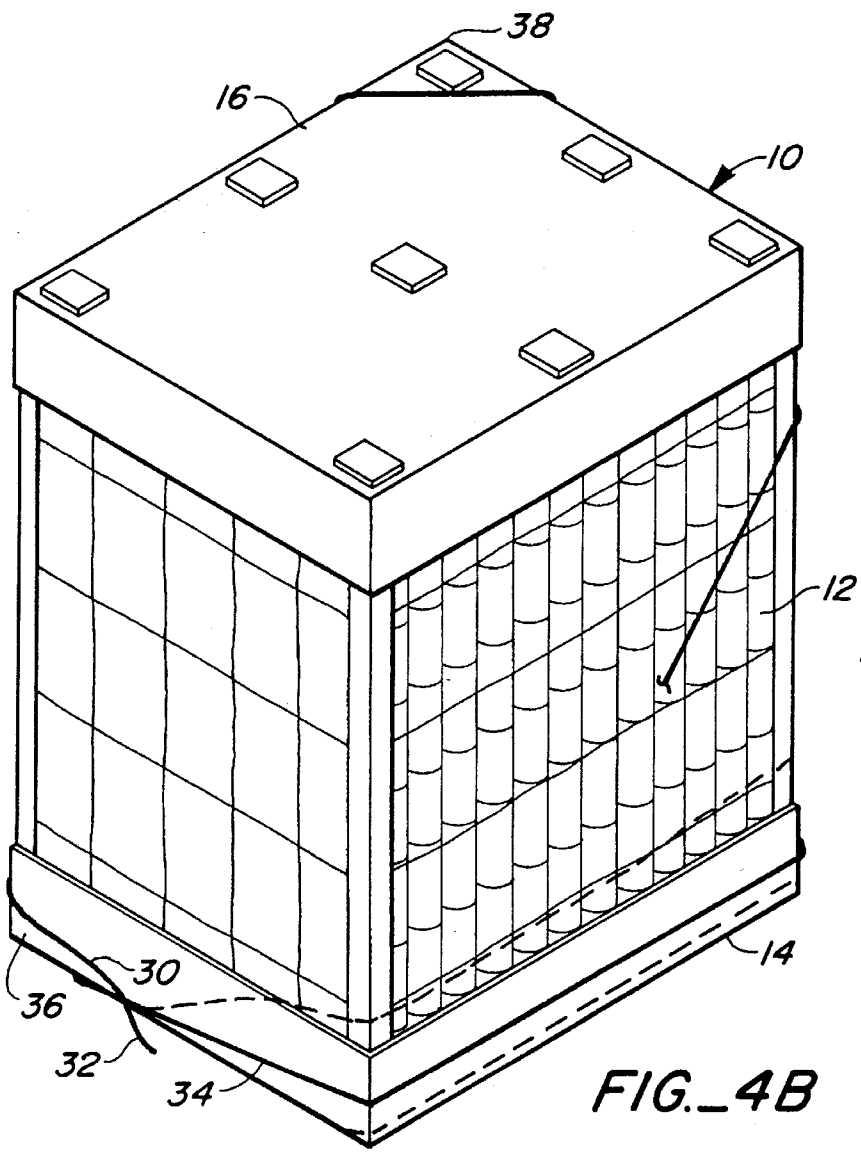

Compression of the web again takes place to form a second web segment 34 of plastic material having a rope-like configuration. Second web segment 34 is looped under the immediately adjacent corner 36 of bottom tray element 14, as shown in FIG. 4B, and is then looped up and over corner 38 of top cap element 16. The stretch wrap machine guides the second web segment 34 over and under two of the four corners of each of the bottom tray element and top cap element as shown in FIGS. 4C and 4D in a criss-cross arrangement that is broadened at each corner to catch the forward side of the corner being roped. This is done to add strength at the sides of the corners not being roped.

It is to be noted that the second web segment is looped only about a single pair of diagonally opposed corners of each of the top cap element and the bottom tray element with the single pair of diagonally opposed corners of the top cap element about which the second web segment is looped being generally ninety degrees out of registry with the single pair of diagonally opposed corners of the bottom tray element about which the second web segment is looped. Second web segment 34 forms a criss-cross pattern between the top cap element along two opposed sides of the bulk package.

Once the two corners of the top cap element and the two corners of the bottom tray element have been looped, the second web segment 34 is spirally wound from bottom to top over the lengths of the second web segment forming the criss-cross pattern as shown in FIG. 4D.

Next, the plastic web is allowed to return to its full width to form a third web segment 40 which is wrapped about the sides of the bulk package form top to bottom to protect the product and contribute to the stability of the bulk package. Third web segment 40 is shown in FIGS. 4, 4D, and 5 in dash line format.

Once the web has arrived at the bottom end of the bulk package it is again compressed back into a rope-like configuration to form fourth web segment 42. Fourth web segment 42 is then wrapped twice about the bottom of the bulk package 10 as shown in FIGS. 4 and 5. A cut is made in the web to terminate the fourth web segment 42 and create an end 44 (see FIGS. 4 and 6). End 44 is then pulled between one of the revolutions of the fourth web segment 42 to secure the two in place relative to the bulk package. Preferably this is accomplished by forming a gap between the fourth web segment portion and the bulk package by applying tension to the fourth web segment portion prior to positioning the fourth web segment terminal end 44 between the fourth web segment portion and the bulk package. Tension is released from the fourth web segment portion after positioning the terminal end between the fourth web segment portion and the bulk package to frictionally lock the fourth web segment terminal end between the fourth web segment portion and the bulk package, effectively securing the loose fourth web segment end.

It has been found that the two corner wrap system described above produces a load that is at least as stable as that produced by the four-corner wrapper with heat-seal process. There is a significant time savings by using the two corner approach and the method of the present invention results in considerably less mechanical wear and tear on the equipment.

Furthermore, the fact that there is no heat sealing of the fourth web segment terminal end to maintain it in place means that the problems inherent in heat sealing operations are not encountered. It has been found that the product produced by the method of the present invention has a far greater survival rate than that using the prior art approach.

The hazards of a long rope tail hanging from the product at a final destination are eliminated. Furthermore, less plastic sheet material is utilized when practicing the present method as compared to the four-corner wrapper with heat-seal process, resulting in less material cost and fewer supplier roll changes.

I claim:

1. A method of wrapping and securing together with an integral web of plastic material the components of a four-sided bulk package having opposed first and second bulk package ends, said bulk package including objects stacked in layers with each layer comprising a plurality of said objects disposed in rows, a bottom tray element at said first bulk package end disposed under the lower-most layer having four corners and a substantially rectangular configuration, and a top cap element at the second bulk package end disposed over the upper-most layer having four corners and a substantially rectangular configuration, and said top cap element and said bottom tray element being in substantial registry, said method comprising the steps of:

compressing a first segment of said web of plastic material into a rope-like configuration, said first segment having a free end;

wrapping said first web segment at least once about the outer periphery of said bulk package defined by the sides of said bulk package at the first bulk package end and about said bottom tray element;

during the step of wrapping said first web segment, securing said first web segment in place on said bulk package at the first bulk package end by joining the first web segment to itself at spaced locations thereon with said first web segment wrapped tightly over the first free end, about the outer periphery of said bulk package, and in frictional engagement with the bulk package outer periphery and first segment free end, the first segment free end being sandwiched between the first segment and the first bulk package end;

after said securing step, compressing a second segment of said web of plastic material into a rope-like configuration to form a second web segment looping under a corner of the bottom tray element and extending along a side of the bulk package to a predetermined corner of the top cap element at said second bulk package end;

looping said second web segment over said predetermined corner of said top cap element and directing said second web segment along adjacent sides of the bulk package and under a corner of said bottom tray element diagonally opposed to the predetermined corner of the top cap element;

continuing said looping step until the second web segment is looped about only a single pair of diagonally opposed corners of said top cap element and is looped about corners of said bottom tray element;

during said looping step, disposing said second web segment in a criss-cross pattern between said top cap element and said bottom tray element along only two sides of the bulk package, and maintaining said web of plastic material out of engagement with said single pair of diagonally opposed corners of said top cap element;

after the step of looping said second web segment, wrapping a third segment of said web around the sides of said bulk package with the web in a substantially uncompressed state to substantially cover the sides of the bulk package;

compressing a fourth segment of said web of plastic material into a rope-like configuration after the step of wrapping said third web segment; and securing the web to itself by wrapping said fourth web segment about said bulk package, severing said fourth web segment to provide a fourth web segment terminal end, and positioning said fourth web segment terminal end between a portion of said fourth web segment wrapped about said bulk package and the bulk package, said securing step including forming a gap between said fourth web segment portion and said bulk package by applying tension to said fourth web segment portion prior to positioning said fourth web segment terminal end between said fourth web segment portion and said bulk package, said tension being released from said fourth web segment portion after positioning said fourth web segment terminal end between said fourth web segment portion and said bulk package to frictionally lock said fourth web segment terminal end between said fourth web segment portion and said bulk package.

2. The method according to claim 1 including the additional step of winding said second web segment in a spiral pattern about the outer periphery of said bulk package defined by the sides of said bulk package between the bottom tray element and the top cap element after said looping step and prior to the step of wrapping the third web segment around the sides of the bulk package.

3. The method according to claim 1 including the step of winding said second web segment in a spiral pattern over that portion of said second web segment forming a criss-cross pattern.

* * * * *